US005378423A

United States Patent [19]

Grimme

[11] Patent Number: 5,378,423

[45] Date of Patent: Jan. 3, 1995

[54] METHOD AND APPARATUS FOR NOTCHING AND CUTTING A CLAY COLUMN SLUG INTO BRICKS

[75] Inventor: Hans Grimme, Falkenstrasse, Germany

[73] Assignee: Hans Lingl GmbH & Co. KG, Neu Elm, Germany

[21] Appl. No.: 869,503

[22] Filed: Apr. 16, 1992

[30] Foreign Application Priority Data

Apr. 26, 1991 [EP] European Pat. Off. ..... 91106773

[51] Int. Cl.[6] ..... B28B 11/08; B28B 11/16

[52] U.S. Cl. ..... 264/293; 264/157; 264/284; 264/296; 264/297.5; 264/297.9; 425/304; 425/385; 425/403.1

[58] Field of Search ..... 425/308, 383, 385, 313, 425/302.1, 301–304, 291, 299, 297, 403.1; 264/145, 151, 157, 209.3, 293, 284, 294, 296, 148, 150, 297.5, 297.9

[56] References Cited

U.S. PATENT DOCUMENTS

| | | | |
|---|---|---|---|
| 663,689 | 12/1900 | Staley et al. | 425/304 |
| 1,281,298 | 10/1918 | Craigen | 425/385 |
| 1,348,932 | 8/1920 | Dochnal | 425/291 |
| 1,555,456 | 9/1925 | Carlyle | 425/385 |
| 2,561,231 | 7/1951 | Rose | 425/291 |
| 3,350,757 | 3/1964 | Bowles | 425/302.1 |
| 3,461,196 | 3/1964 | Bowles | 264/148 |
| 3,771,932 | 11/1973 | Van Daal | 425/385 |
| 4,311,073 | 1/1982 | Brugger et al. | 264/157 |
| 4,419,065 | 12/1983 | Cox | 425/302.1 |
| 4,436,501 | 3/1984 | Kenworthy | 264/157 |
| 5,084,282 | 1/1992 | Stuart et al. | 425/304 |

FOREIGN PATENT DOCUMENTS

| | | | |
|---|---|---|---|
| 0515704B1 | 12/1992 | European Pat. Off. . | |
| 1433676 | 2/1966 | France . | |
| 2159427 | 6/1973 | Germany . | |
| 2832167 | 2/1980 | Germany . | |
| 3311541 | 6/1984 | Germany . | |
| 3906461 | 4/1990 | Germany . | |
| 2137135 | 10/1984 | United Kingdom . | |
| 1034910 | 8/1983 | U.S.S.R. | 264/148 |
| 1046100 | 10/1983 | U.S.S.R. | 425/301 |

*Primary Examiner*—Jay H. Woo
*Assistant Examiner*—Joseph Leyson
*Attorney, Agent, or Firm*—Nixon & Vanderhye

[57] ABSTRACT

A clay column slug is efficiently and accurately notched around its entire circumference before being cut into individual bricks. The slug is pushed into a roller assembly having two opposing upper parallel rows of rollers and two lower parallel rows of corresponding rollers to form notches in upper and lower surfaces of the slug. The upper and lower rows of rollers are compressed vertically together to form partial notches in front and rear surfaces of the slug. The slug is elevated up and out of the compressed roller assembly between the two opposing upper rows of rollers which completes the notches in the front and rear slug surfaces. After notching, the slug is further elevated through a set of parallel wires aligned with and positioned directly above the upper rows of rollers. Alignment with corresponding rollers insures the wires cut the clay slug through the slug notches. The resulting bricks have smooth, beveled, and uniform edges free of lugs, burrs, and other material buildup.

13 Claims, 2 Drawing Sheets

METHOD AND APPARATUS FOR NOTCHING AND CUTTING A CLAY COLUMN SLUG INTO BRICKS

FIELD OF THE INVENTION

The present invention relates to a method and apparatus for notching clay column slugs prior to cutting the slugs into green bricks, and in particular, for evenly notching each slug completely about its circumference to obtain smooth, chamfered brick edges free of extraneous burrs and the like.

BACKGROUND OF THE INVENTION

In the conventional manufacture of bricks, unfired and pliable clay is extruded continuously into an elongated column which is cut transversely into a series of column slugs. Typically, each column slug is pushed transversely through a plurality of evenly spaced cutting wires to form individual green bricks. The green bricks are separated, conveyed to and set on cars, moved into drying ovens, transferred to a kiln and fired.

Prior art brick cutting methods are satisfactory for only those applications where some brick edge and face defects are acceptable. Cutting a column slug into green bricks by simply pushing cutting wires through the clay (without prior notching along the intended cutting lines) produces sharp uneven edges and burrs of clay. It also produces lugs on the edges where the cutting wires are leaving the brick. These lugs are aesthetically unacceptable and especially conducive to breaking and chipping. Stacking on kiln cars, coupled with the normal rocking and jostling encountered during cart movement, virtually guarantees chipping of abutting brick edges of many bricks. Lug and chipping defects result in rejection of a significant percentage of finished bricks.

One attempt to cure such conventional brick cutting procedures is disclosed in U.S. Pat. Nos. 3,350,757 and 3,461,196 to Bowles. Here, in a first embodiment (FIGS. 1–4) clay bars (slugs) cut from an extruded clay column are conveyed to a first station. Opposing sets of vertically-mounted wedge-shaped knife blades are simultaneously pressed into two opposing sides of the clay slug to form vertical grooves or notches in these sides of the slug along intended cutting lines. The blades are retracted, and the slug is conveyed to a second station where a "pusher" block contacts one side of the vertically-notched slug and pushes it toward a cutting station. Vertical wires are aligned with vertical notches in the column slug and a corresponding roller is mounted along a shaft in front of each wire with its planes of rotation aligned with its corresponding cutting wire. As the pusher block forces the column slug through the cutting assembly, each roller forms (in advance of the cutting wire) a horizontal notch or groove on the top surface of the column slug that is aligned with a corresponding vertically-formed notch. The cutting wires, positioned directly behind corresponding rollers, traversely cut the column slug through the troughs of the notches to form individual green bricks. In a second Bowles embodiment (FIGS. 5–8), the brick cutting wires are horizontally disposed and the slug is pushed upward through the wires to cut individual bricks. A notch-forming roller is aligned with each wire at each side of the slug as to make vertical notches prior to cutting. The same rollers form a horizontal notch on the top side of the slug as it is being laterally transferred into the cutting station.

While the Bowles three-side notching methods are an improvement over conventional methods, they suffer from a number of problems. First, the notching and cutting operation requires transfer of the slug to plural process stations and/or use of different notching apparatus. For example, in the first Bowles embodiment, after the column slug is transferred to the first station and vertically notched, it must be moved again to the second station and carefully aligned with respect to the wire/disk cutting assembly to ensure alignment with and cutting along the vertical notches.

High brick manufacturing capacities make proper alignment extremely difficult to achieve in the Bowles system. Vertical and horizontal notches inevitably become misaligned, resulting in bricks which are unacceptable aesthetically. Additionally, pushing the bricks through rollers and wires in the second station causes lugs to be pulled at brick edges where rollers and wires leave the cut slug. Again, this is not acceptable. Moreover, the second Bowles embodiment does not allow notching of the bottom of the slug, and therefore, similar lugs are pulled at the edges of the brick.

Another attempted solution is disclosed in German Patent DE-AS*2,832,167—Borgmann. The Borgmann device features a roller assembly with an upper and a lower row of notching rollers positioned in the same vertical plane. A pushing block delivers the column slug to a first position where the roller assembly can initially contact the front surface of the slug. The retracted roller assembly is then extended vertically across the front vertical face of the slug and in the process forms a plurality of parallel notches. When the roller assembly is fully extended, the pushing mechanism forces the column slug between the upper and lower set of rollers to form parallel transverse notches along the top and bottom surfaces of the slug. The column slug is then stopped at a second position where the roller assembly contacts the rear vertical face of the column slug. The roller assembly is then retracted thereby forming a second vertical notch on the rear face of the slug. In this manner, all four sides of the slug are notched prior to brick cutting.

Although an improvement over the Bowles system, the Borgmann device has a number of drawbacks. For example, because of the inertia of the clay column slug, it is difficult to accurately and uniformly always position the entire length of the slug at exactly the same transverse position relative to the roller assembly. Consequently, when the roller assembly is extended across the front and rear vertical faces of the slug, notches of irregular depth may be formed from one cycle to the next when the front notches are compared to the rear notches. If one end of the slug is positioned slightly forward of the preferred position, for example, the depth of the vertical notch may be greater at the forward end of the slug than at the rear end.

The frictional resistance between the bottom of the slug and the conveyor varies along the slug length. As a result, when the upper row of Borgmann rollers is moved down along the rear vertical slug face, portions of the slug may move in low friction areas pushing those portions away from the rollers resulting in shallow, inconsistent notch depth. Furthermore, when the upper and lower rows of Borgmann rollers notch the top and bottom surfaces of the column slug, respectively, clay material is displaced in the direction where the rollers leave the slug, so that lugs are formed, which are not acceptable aesthetically.

Accordingly, there is still need for a brick handling system which more efficiently and effectively provides more uniformly cut bricks without lugs on their edges. In addition, it is desirable that the notching and cutting operations take place at a single work station using a single piece of equipment.

SUMMARY OF THE INVENTION

A clay column slug is efficiently and accurately notched around its entire circumference before being cut into individual green bricks. The slug is pushed into a roller assembly having two parallel upper rows and two parallel lower rows of rollers to simultaneously form notches in upper and lower surfaces of the slug. The upper and lower rows of rollers are then moved vertically towards one another to form partial notches and thereby preform the edges of subsequently cut bricks at the front and rear surfaces of the slug. In this way, lugs do not form when the slug is then elevated up and out of the compressed roller assembly passing between the two parallel upper rows of rollers to complete formation of notches in the front and rear slug surfaces.

After such notching, the slug is further elevated through a set of parallel wires aligned with and positioned directly above the upper rows of rollers. The cutting wires are preferably inclined with respect to the slug surfaces. Wire alignment with corresponding rollers insures that the wires cut the clay through the previously formed slug notches. The resulting bricks have smooth, beveled, and uniform edges which are free of lugs where rollers or wires leave the slug.

A notching apparatus for completely notching the circumference of a clay slug includes a set of lower pairs of rollers with each pair having a front and back roller and a set of upper pairs of rollers corresponding and aligned with the lower pairs of rollers. A crank alternately simultaneously moves the upper and lower sets of rollers to an extended position (maximum separation) and a retracted position (minimum separation). A positioning mechanism transversely positions the column slug in a first horizontal direction between the upper and lower sets of roller pairs when the roller pairs are in the extended position. As a result, the rollers contact the slug and form parallel grooves at a uniform depth across the top and bottom faces of the slug. The upper and lower sets of roller pairs are then moved to a retracted position. During retraction, the upper and lower sets of rollers contact the front and rear vertical faces of the column slug to form partial grooves in the clay. The grooves on these faces are completed when the slug is pushed in a second vertical direction up and out of the roller assembly.

Thus, at a single station using a single apparatus the upper and lower sets of roller pairs form parallel, evenly-spaced grooves of uniform depth and shape about the entire circumference of the slug. Inclined cutting wires aligned with the roller pairs are positioned above the upper set of roller pairs so that when the slug is pushed up and out of the roller assembly, the wires cut the slug through the grooves to produce green bricks.

BRIEF DESCRIPTION OF THE DRAWINGS

These and other features and advantages of the present invention will be readily apparent to one of ordinary skill in the art from careful study of the following written description, read in conjunction with the drawings, in which like reference numerals are used to identify like parts throughout the drawings.

DETAILED DESCRIPTION OF THE EXEMPLARY EMBODIMENT

Figure 2:
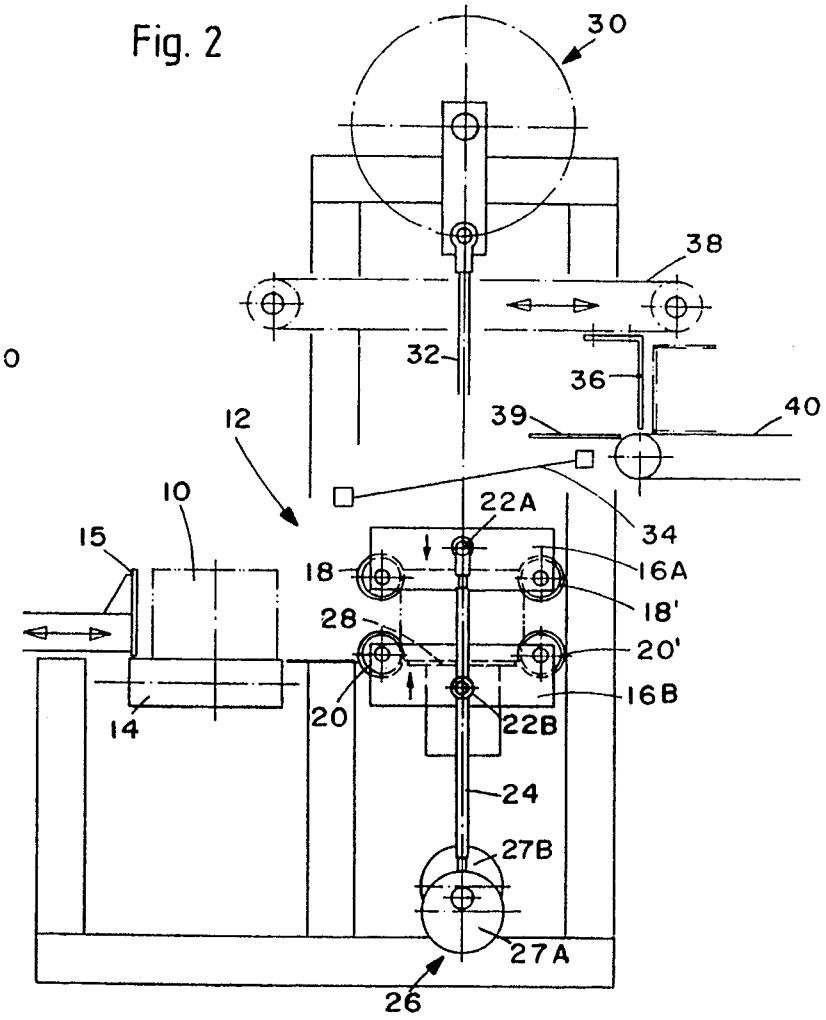
FIG. 2 is a side view of the notching apparatus of the present invention illustrating notching of front and rear vertical surfaces of the column slug.
Figure 1:
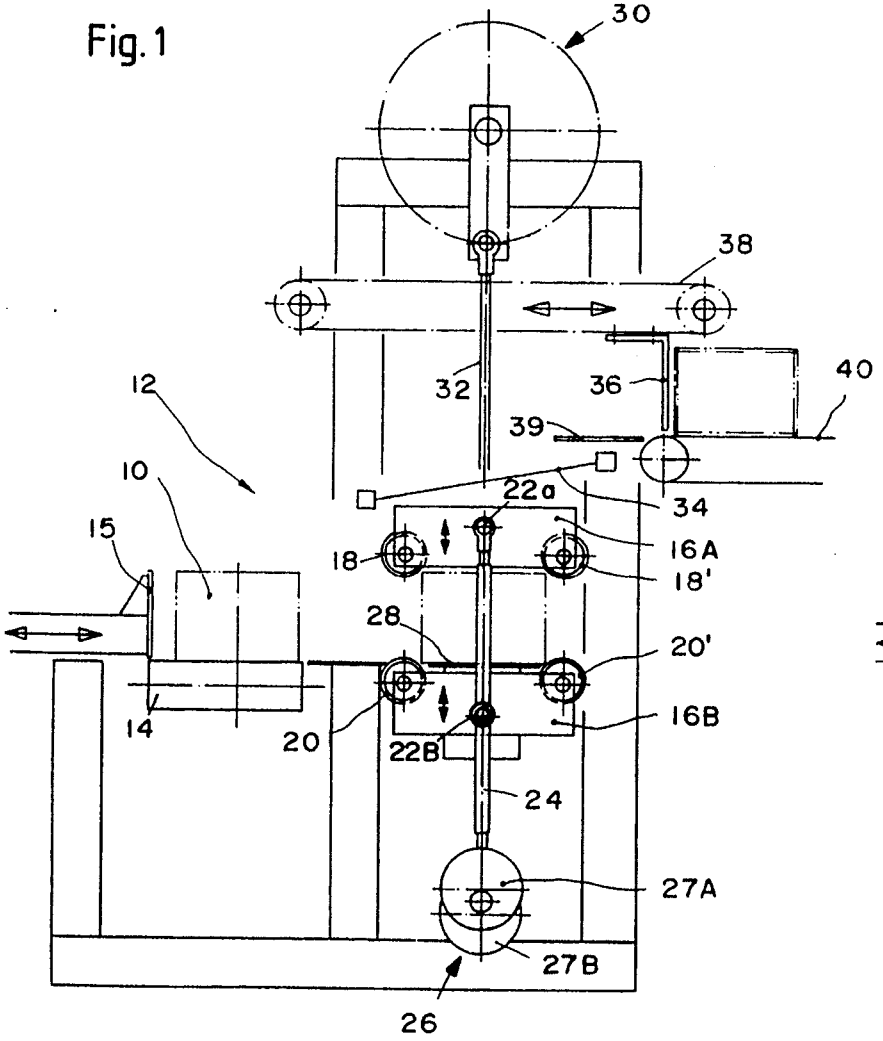
FIG. 1 is a side view of an automated brick handling system illustrating the notching of top and bottom horizontal surfaces of a clay column slug.
Figure 3:
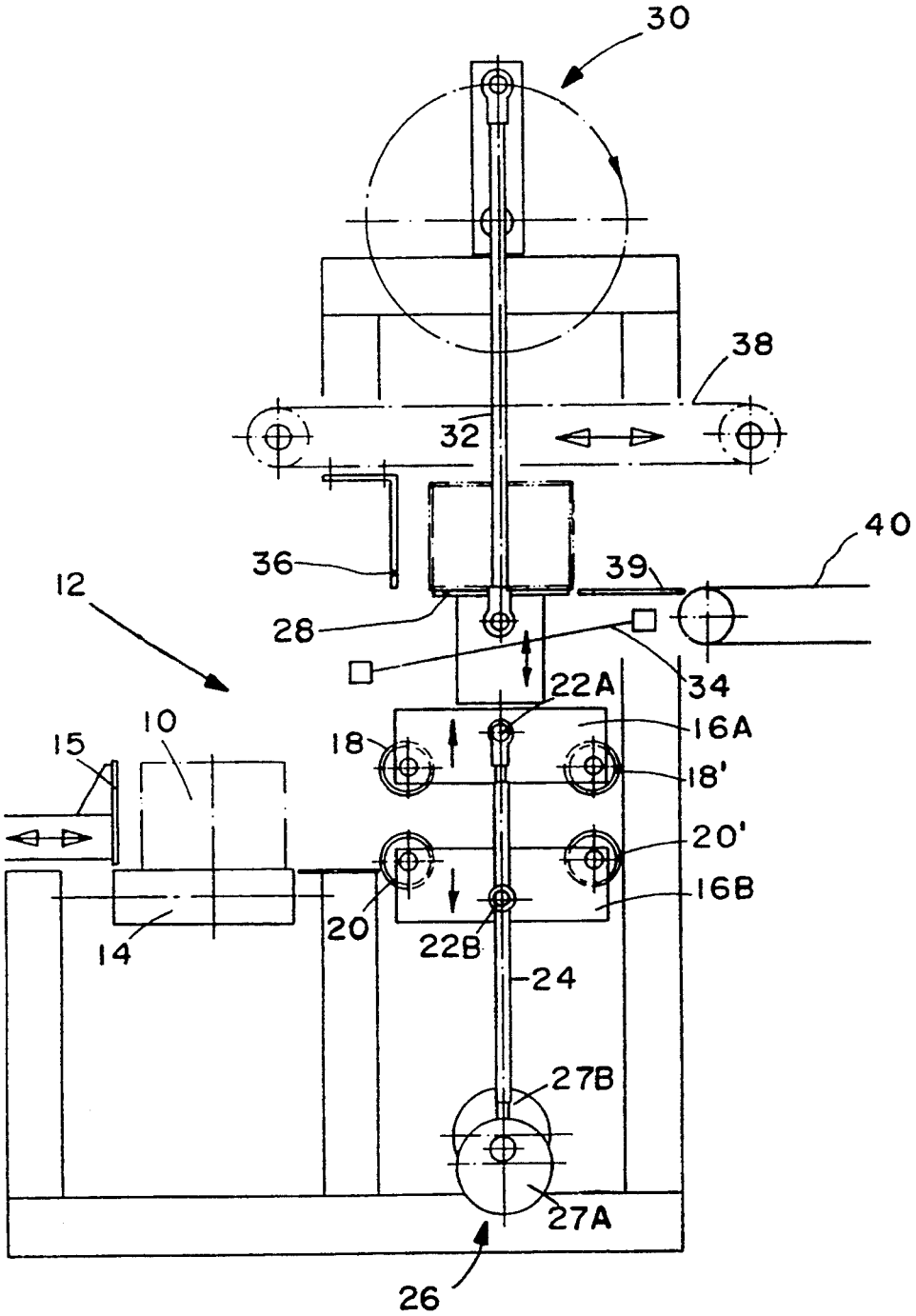
FIG. 3 is a side view of the notching apparatus illustrating cutting of the notched column slug into individual green bricks.

Referring to FIGS. 1–3, an exemplary embodiment of the present invention will be described. In FIG. 1, clay column slug 10 (shown in cross-section) is delivered to a notching apparatus 12 by a conveyor 14. Pushing member 15 extending along the length of clay column slug 10 is actuatable to push column slug 10 transversely away from conveyor 14 towards notching assembly 12.

Notching assembly 12 includes upper and lower rectangularly-shaped support members 16A, 16B which are parallel to each other and located beyond the ends of column slug 10. Attached to both ends of upper support member 16A are plural spaced-apart pairs of notching rollers 18 and 18' (only one pair is shown in the FIGURES). All upper notching rollers are aligned in a horizontal plane defined by support shafts carried by upper support member 16A. Moreover, each upper roller pair 18, 18' is aligned in a vertical plane with a corresponding cutting wire 34. Each upper roller pair 18, 18' is spaced from adjacent similar roller pairs by the width of a single brick as should be apparent to those in the art. Lower support member 16B includes similar pairs of lower notching rollers 20, 20' (only one pair is shown in the FIGURES) vertically aligned with corresponding upper notch roller pairs 18, 18'. Each notching roller is beveled to form a smooth, V-shaped notch or groove in the clay column slug.

Both sides of upper and lower support members 16A, 16B have protruding shafts 22A and 22A' (not shown) and 22B and 22B' (not shown) rotatably coupled to corresponding sets of connecting rod members illustrated generally at 24. The lower support connecting rod members (not shown) are inset between the upper support connecting rod members. Both sets of connecting rod members 24 rotatably attach to a crank shaft at points which are eccentrically offset, indicated generally at 26 and driven by a conventional motor (not shown). The upper support rods are rotatably connected to one set of cranks 27A, 27A' (27A' not shown) and the lower support rods are rotatably connected to another set of cranks 27B, 27B' (27B' not shown) which are 180° out of phase with cranks 27A, 27A'. Rotation of the drive crank shaft 26 retracts or extends the upper and lower supports 16A and 16B either toward or away from each other, respectively. In other words, in the extended position, upper support 16A moves up and the lower support 16B moves down. In the retracted position, upper support 16A moves down and lower support 16B moves up.

An elevating slotted platform 28 (upon which column slug 10 rests during notching and cutting operations) is raised and lowered by a rotational crank mechanism 30 rotatably connected via rod shafts 32, 32' (32' not shown) to the elevator platform 28. Plural equally-distanced, parallel inclined cutting wires 34 (only one wire is shown) are positioned above the notching device 12. Upward vertical movement of elevator platform 28 (in response to rotation of crank mechanism 30) forces column slug 10 through cutting wires 34 to form a plurality of green bricks. Pushing block 36 connected to conveyor 38 next contacts the cut green bricks on their rear vertical face, and in response to movement of conveyor 38, pushes a row of just-cut green bricks over intermediate supports 39 onto discharge conveyor 40. Discharge conveyor 40 transfers the row of green bricks to other stations for further handling and stacking.

The slug notching and cutting operation of the present invention will now be described. When drive shaft 26 is in a first rotational position shown in FIG. 1, upper and lower support members 16A and 16B are at their extended positions to receive column slug 10. As pushing member 15 pushes column slug 10 into notching assembly 12, the first rows of upper and lower rollers (18 and 20) contact the top and bottom surfaces of slug 10 and form parallel notches in the clay.

When slug 10 is finally positioned on elevator 28, crank shaft 26 is rotated 180° to retract the upper and lower support members 16A and 16B towards each other into their retracted positions, as shown in FIG. 2. In retracting, upper and lower roller pairs 18, 18' and 20, 20' are pressed into the front and rear sides (at both top and bottom) of the column slug to form partial vertical side notches in the clay. Elevator 28 then lifts slug 10 up and out of the notching assembly so that upper roller pairs 18, 18', now pressed into the slug sides, complete the partial notches on the front and rear slug sides. As a result, the entire circumference of column slug 10 is notched. Partially notching the vertical sides of slug 10 minimizes the possibility of clay being displaced toward the bottom surfaces of the slug by upper roller pairs 18, 18' when slug 10 is elevated out of the notching assembly. In this way, formation of lugs and other extraneous burrs at the bottom slug surface are avoided.

As the slug is being elevated, it is also forced through cutting wires 34 which are aligned with corresponding notches thereby cutting column slug 10 through the troughs or valleys of the circumferential notches, as shown in FIG. 3. Preferably, cutting wires 34 are inclined with respect to the slug surface to minimize lug formation as well as the length of wire required to contact the slug making for more efficient, cleaner cuts. The green bricks thus formed are removed from elevator 28 to conveyor 40 by pushing block 36 which is driven by conveyor 38.

The present invention thus simultaneously notches and cuts a column slug into green bricks at a single station using a single piece of equipment with few needed machine cycles. In this way the present invention substantially ensures that (1) the entire circumference of the slug is notched; (2) all notches are substantially uniform in shape and depth; (3) the cutting wires cut the slug in the valley of the notches; (4) the brick edges are uniform and slightly beveled to prevent chipping and breaking during firing and handling; and (5) the brick edges and faces are free of lugs, burrs, and any other material build up which occurs during prior art slug notching and/or cutting operations.

Although only one exemplary embodiment of the present invention is illustrated in the drawings and described in detail, it will be understood by those skilled in the art that the present invention is not limited to the exemplary embodiment disclosed but is capable of rearrangement, modification, and substitution of the parts, elements, and steps without departing from the spirit and scope of the invention.

What is claimed is:

1. A brick manufacturing method that forms notches in a clay column slug having elongated first and second opposing vertical surfaces and elongated first and second opposing horizontal surfaces about a cross-sectional circumference defined by the vertical and horizontal surfaces, at spaced intervals therealong, at one location where all notching operations are carried out, said method comprising the steps of:

(a) notching the elongated first and second opposing horizontal surfaces of the slug by pushing the slug in a horizontal direction between upper first and second sets and lower first and second sets of rollers, wherein each set of rollers extends in a direction in which the slug is elongated, said upper sets of rollers are horizontally aligned and spaced apart by about a width between the vertical surfaces, said lower sets of rollers are horizontally aligned and spaced apart by about the width, said upper and lower first sets of rollers are vertically-aligned and spaced apart by about a height between the horizontal surfaces, and said upper and lower second sets of rollers are vertically-aligned and spaced-apart by about the height;

(b) moving the upper and lower sets of rollers towards one another and partly along the vertical surfaces to form partial notches in the vertical surfaces;

(c) completing notching of the vertical surfaces by pushing the slug vertically between the upper and lower sets of rollers; and (d) cutting the slug along the notches into green bricks whereby said green bricks are manufactured free of lugs.

2. Apparatus for notching an elongated clay column slug having elongated first and second opposing vertical surfaces and elongated first and second opposing horizontal surfaces about a cross-sectional circumference defined by the vertical and horizontal surfaces at spaced intervals therealong, said apparatus comprising:

upper first and second sets and lower first and second sets of rollers, wherein each set of rollers extends in a direction in which the slug is elongated, said upper sets of rollers are horizontally aligned and spaced apart by about a width of the cross-sectional circumference between the vertical surfaces, said lower sets of rollers are horizontally aligned and spaced apart by about the width, said upper and lower first sets of rollers are vertically-aligned and spaced apart by about a height of the cross-sectional circumference between the horizontal surfaces, and said upper and lower second sets of rollers are vertically-aligned and spaced-apart by about the height;

means for pushing the slug in a horizontal direction between the upper first and second sets of rollers and the lower first and second sets of rollers thereby notching the elongated first and second opposing horizontal surfaces; and means for partially retracting the upper and lower sets of rollers toward one another to form partial notches in the vertical surfaces thereby preventing formation of lugs.

3. Apparatus as claimed in claim 2, further comprising:

means for moving the slug vertically between the upper and lower sets of rollers to complete notching of the vertical surfaces.

4. Apparatus as claimed in claim 3, further comprising:

a plurality of cutters for cutting said slug into bricks along said notches.

5. Apparatus as claimed in claim 2, wherein said means for partially retracting includes:

a first reciprocatable assembly connected to the upper first and second sets of rollers, and a second reciprocatable assembly connected to the lower first and second sets of rollers.

6. Apparatus as claimed in claim 5, wherein said means for partially retracting further comprises:

a crankshaft drivably connected to said first and second reciprocatable assemblies so as to continuously reciprocate them towards and away from one another as the crankshaft is rotated.

7. Apparatus according to claim 6, wherein said first reciprocatable assembly is connected to first rod members, said second reciprocatable assembly is connected to second rod members, and said first rod members are connected to points on the crankshaft that are eccentrically offset from points on the crankshaft to which said second rod members are connected.

8. A method for processing a clay column slug having elongated first and second opposing vertical surfaces and elongated first and second opposing horizontal surfaces about a cross-sectional circumference defined by the vertical and horizontal surfaces, comprising:

(a) moving said slug in a horizontal direction into a roller assembly having upper first and second and lower first and second rows of rollers, each row of rollers extending in a direction in which the slug is elongated, said upper and lower first rows of rollers being vertically aligned and separated by about a height defined between the horizontal surfaces of the slug, said upper and lower second rows of rollers being vertically aligned and separated by about the height, to form upper and lower notches across upper and lower horizontal surfaces of said slug, respectively, wherein said upper rows of rollers are horizontally aligned and spaced apart by about a width between said vertical surfaces and said lower rows of rollers are horizontally aligned and spaced apart by about said width;

(b) moving said upper and lower rows of rollers toward one another to form partial notches in said vertical surfaces of said slug; and (c) moving said slug vertically out of said roller assembly to complete said partial notches along said vertical surfaces wherein said slug is uniformly notched about its entire circumference.

9. A method according to claim 8, further comprising:

(d) cutting said slug along said notches into bricks using a plurality of cutting wires inclined relative to said horizontal surfaces of the slug as said slug is moved vertically.

10. The method according to claim 9, further comprising:

(e) transporting said cut bricks away from the roller assembly for additional processing and handling.

11. An apparatus for processing a clay column slug having elongated opposing vertical surfaces and elongated opposing horizontal surfaces, comprising:

at least one lower, horizontally-aligned roller pair having lower first and second rollers spaced apart by about a first distance between the vertical surfaces;

at least one upper, horizontally-aligned roller pair having upper first and second rollers spaced apart by about the first distance, wherein the upper and lower pairs are vertically aligned and spaced apart by about a second distance between the horizontal surfaces;

means for reciprocatably moving the at least one lower and upper roller pairs toward and away from one another, wherein the at least one lower and upper roller pairs are moved away from one another to an extended first position and the at least one lower and upper roller pairs are moved toward one another to a retracted second position; and means for moving the slug between the at least one lower and upper horizontally-aligned roller pairs when the pairs are in the first position to form at least one groove in the horizontal surfaces and for moving the slug between the at least one lower and upper, horizontally-aligned roller pairs when the pairs are in the second position to form at least one groove in the vertical surfaces so that at least one circumferential groove is formed in the slug.

12. An apparatus according to claim 11, further comprising:

cutting means positioned adjacent to and aligned with the roller pairs for cutting the slug along the grooves.

13. An apparatus according to claim 11, wherein the means for moving the slug between the first and second rollers is an elevator, the elevator being driven by a rotating crank.

* * * * *